US010857792B2

(12) United States Patent
Giusti et al.

(10) Patent No.: US 10,857,792 B2
(45) **Date of Patent: *Dec. 8, 2020**

(54) MICROFLUIDIC MEMS PRINTING DEVICE WITH PIEZOELECTRIC ACTUATION

(71) Applicant: STMICROELECTRONICS S.R.L., Agrate Brianza (IT)

(72) Inventors: Domenico Giusti, Caponago (IT); Mauro Pasetti, Milan (IT)

(73) Assignee: STMICROELECTRONICS S.R.L., Agrate Brianza (IT)

( * ) Notice: Subject to any disclaimer, the term of this patent is extended or adjusted under 35 U.S.C. 154(b) by 0 days.

This patent is subject to a terminal disclaimer.

(21) Appl. No.: 16/262,789

(22) Filed: Jan. 30, 2019

(65) Prior Publication Data

US 2019/0160816 A1 May 30, 2019

Related U.S. Application Data

(63) Continuation of application No. 15/726,169, filed on Oct. 5, 2017, now Pat. No. 10,232,615.

(30) Foreign Application Priority Data

Feb. 21, 2017 (IT) ..... 102017000019431

(51) Int. Cl.
*B41J 2/14* (2006.01)
*B41J 2/045* (2006.01)

(52) U.S. Cl.
CPC ..... *B41J 2/14233* (2013.01); *B41J 2/04541* (2013.01); *B41J 2/04581* (2013.01); *B41J 2/14201* (2013.01); *B41J 2002/1437* (2013.01); *B41J 2002/14241* (2013.01); *B41J 2002/14459* (2013.01); *B41J 2202/13* (2013.01)

(58) Field of Classification Search
CPC ..... B41J 2/14233; B41J 2/14201; B41J 2002/14459; B41J 2002/1437; B41J 2002/14241; B41J 2/04541; B41J 2/04581; B41J 2202/13
See application file for complete search history.

(56) References Cited

U.S. PATENT DOCUMENTS

| | | | |
|---|---|---|---|
| 5,889,539 A | 3/1999 | Kamoi et al. | |
| 6,378,996 B1 | 4/2002 | Shimada et al. | |
| 6,386,672 B1 | 5/2002 | Kimura et al. | |
| 8,454,132 B2 | 6/2013 | Menzel et al. | |
| 9,033,469 B2 | 5/2015 | Gardner et al. | |
| 9,174,445 B1 | 11/2015 | Prati et al. | |
| 9,346,268 B2 | 5/2016 | Suzuki | |
| 9,522,528 B2 | 12/2016 | Yamada | |
| 10,232,615 B2 * | 3/2019 | Giusti | B41J 2/04581 |

(Continued)

FOREIGN PATENT DOCUMENTS

JP 2000-289204 A 10/2000

*Primary Examiner* — Geoffrey S Mruk
(74) *Attorney, Agent, or Firm* — Seed IP Law Group LLP

(57) ABSTRACT

A microfluidic device, having a containment body accommodating a plurality of ejecting elements arranged adjacent to each other. Each ejecting element has a liquid inlet, a containment chamber, a piezoelectric actuator and an ejection nozzle. The piezoelectric actuators of each ejecting element are connected to a control unit configured to generate actuation signals and to be integrated in the containment body.

18 Claims, 9 Drawing Sheets

(56) References Cited

U.S. PATENT DOCUMENTS

| | | | | |
|---|---|---|---|---|
| 2003/0117041 | A1 | 6/2003 | Kurihara et al. | |
| 2011/0139901 | A1 | 6/2011 | Menzel et al. | |
| 2014/0063095 | A1 | 3/2014 | Yokoyama et al. | |
| 2014/0232791 | A1 | 8/2014 | Gardner et al. | |
| 2014/0313264 | A1 | 10/2014 | Cattaneo et al. | |
| 2015/0290937 | A1 | 10/2015 | Yazaki et al. | |
| 2017/0151784 | A1 | 6/2017 | Giusti et al. | |
| 2017/0266969 | A1* | 9/2017 | Kashimura ..... | B41J 2/04541 |

* cited by examiner

MICROFLUIDIC MEMS PRINTING DEVICE WITH PIEZOELECTRIC ACTUATION

BACKGROUND

Technical Field

The present disclosure relates to a microfluidic MEMS printing device with piezoelectric actuation.

Description of the Related Art

As is known, for spraying ink and/or fragrances, for example perfumes, the use of small-dimension, microfluidic devices has been proposed that may be manufactured using microelectronics manufacturing techniques.

For example, U.S. Pat. No. 9,174,445 discloses a microfluidic device designed for thermally spraying printer ink onto paper.

Another type of microfluidic device suitable for spraying fluids is based on the piezoelectric principle. In particular, piezoelectric actuation devices may be classified according to the oscillation mode, longitudinal or flexural. Hereinafter, reference will be made to devices operating in flexural oscillation mode, without the disclosure being limited thereto.

One embodiment of a microfluidic device with piezoelectric actuation of the flexural type is for example described in US 2014/0313264 and is shown in FIG. 1, referring to a single ejecting element, indicated with 30 and integrated in a microfluidic device 1.

The ejecting element 30 in FIG. 1 comprises a lower portion, an intermediate portion and an upper portion, mutually superposed and bonded.

The lower portion is formed by a first region 32, of semiconductor material, having an inlet channel 40.

The intermediate portion is formed by a second region 33, of semiconductor material, that laterally delimits a fluid containment chamber 31. The fluid containment chamber 31 is furthermore delimited on the bottom by the first region 32 and on the top by a membrane layer 34, for example of silicon oxide. The area of the membrane layer 34 on top of the fluid containment chamber 31 forms a membrane 37. The membrane layer 34 is formed of a such thickness to be able to flex, for example of about 2.5 μm.

The upper portion is formed by a third region 38, of semiconductor material, which delimits an actuator chamber 35, superposed on the fluid containment chamber 31 and on the membrane 37. The third region 38 has a through channel 41, in communication with the fluid containment chamber 31 via a corresponding opening 42 in the membrane layer 34.

A piezoelectric actuator 39 is arranged on top of the membrane 37, within the actuator chamber 35. The piezoelectric actuator 39 is formed of a pair of electrodes 43, 44, mutually superposed, and a piezoelectric material layer 29, for example PZT (Pb, Zr, $TiO_3$), extends between them.

A nozzle plate 36 is arranged on top of the third region 38, bonded thereto by a bonding layer 47. The nozzle plate 36 has a hole 48, arranged on top of and fluidically connected with the channel 41 via an opening 46 in the bonding layer 47. The hole 48 forms a nozzle of a droplet emission channel, indicated overall at 49 and also comprising the through channel 41 and the openings 42, 46.

In use, a fluid or liquid to be ejected is supplied to the fluid containment chamber 31 through the inlet channel 40 and an external control device generates actuation control signals, applying appropriate voltages between the electrodes 43, 44. In particular, in a first phase, the electrodes 43, 44 are biased so as to cause the membrane 37 to deflect towards the outside of the fluid containment chamber 31. The fluid containment chamber 31 increases in volume and thus fills with liquid. In a second phase, the piezoelectric actuator 39 is controlled in the opposite direction, so as to deflect the membrane 37 towards the inside of the fluid containment chamber 31, causing a movement of the fluid in the fluid containment chamber 31 towards the droplet emission channel 49. Thus, a controlled expulsion of a droplet is caused, as shown by the arrow 45. Subsequently, the first phase is carried out so as to again increase the volume of the fluid containment chamber 31, drawing in more fluid through the inlet channel 40.

The microfluidic devices with piezoelectric actuation are particularly advantageous as regards print quality, low costs and minimal dimensions of the droplet, which allows a print to be obtained with great detail and/or high definition, in addition to a high spraying density.

In general, each microfluidic device comprises a large number of ejecting elements, adjacent to each other, so as to have the desired printing characteristics. For example, FIG. 2 shows schematically the arrangement of a plurality of ejecting elements 30, arranged adjacent to each other in various rows.

One existing problem with the microfluidic devices of the piezoelectric type in question resides in that each ejecting element can be controlled individually, by a specific control signal supplied from the outside of the microfluidic device.

This means that the microfluidic device has to provide a number of contact pads equal to the number of individual ejecting elements. For example, current devices have 600 ejecting elements and associated pads, and it is desired to increase the number of ejecting elements (and thus of the associated contact pads) up to 1500 and beyond.

Consequently, the area of the device should be sufficiently large to be able to accommodate all the contact pads, which may be a drawback in some applications wherein reduced dimensions are required. Furthermore, due to the high number of pads, the electrical connection operations is complex. In fact, the device is generally fixed to a support structure (for example of flexible type) and the contact pads are connected to an external control device, generally in the form of an ASIC (application specific integrated circuit), by wire bonding. On the other hand, forming a large number of wired connections is costly, complicated and has a high impact on the general yield.

BRIEF SUMMARY

One or more embodiments of the present disclosure provide a microfluidic device that overcomes drawbacks of the prior art.

According to one or more embodiments of the present disclosure, a microfluidic device includes:

a containment body;

a plurality of ejecting elements arranged adjacent to each other and accommodated in the containment body, each ejecting element including a liquid input, a containment chamber, a piezoelectric actuator, and an ejection nozzle; and a control unit configured to generate actuation signals that actuate the piezoelectric actuators, wherein the control unit is integrated in the containment body.

BRIEF DESCRIPTION OF THE SEVERAL VIEWS OF THE DRAWINGS

For a better understanding of the present disclosure, preferred embodiments thereof are now described, purely by way of non-limiting example, with reference to the attached drawings, wherein.

DETAILED DESCRIPTION

Figure 3:
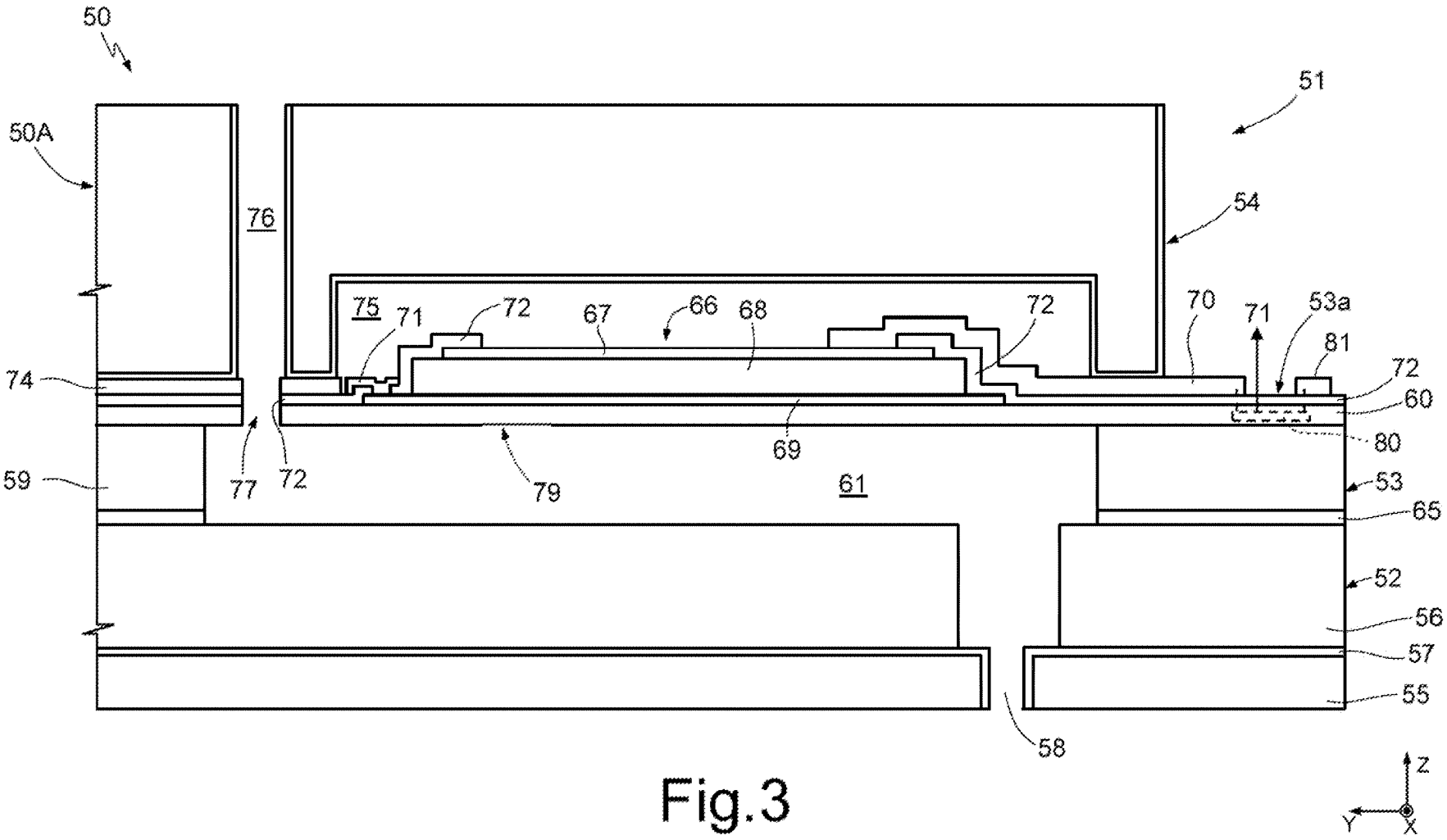
FIG. 3 is a cross-section of an ejecting element of the present microfluidic device.
Figure 4:
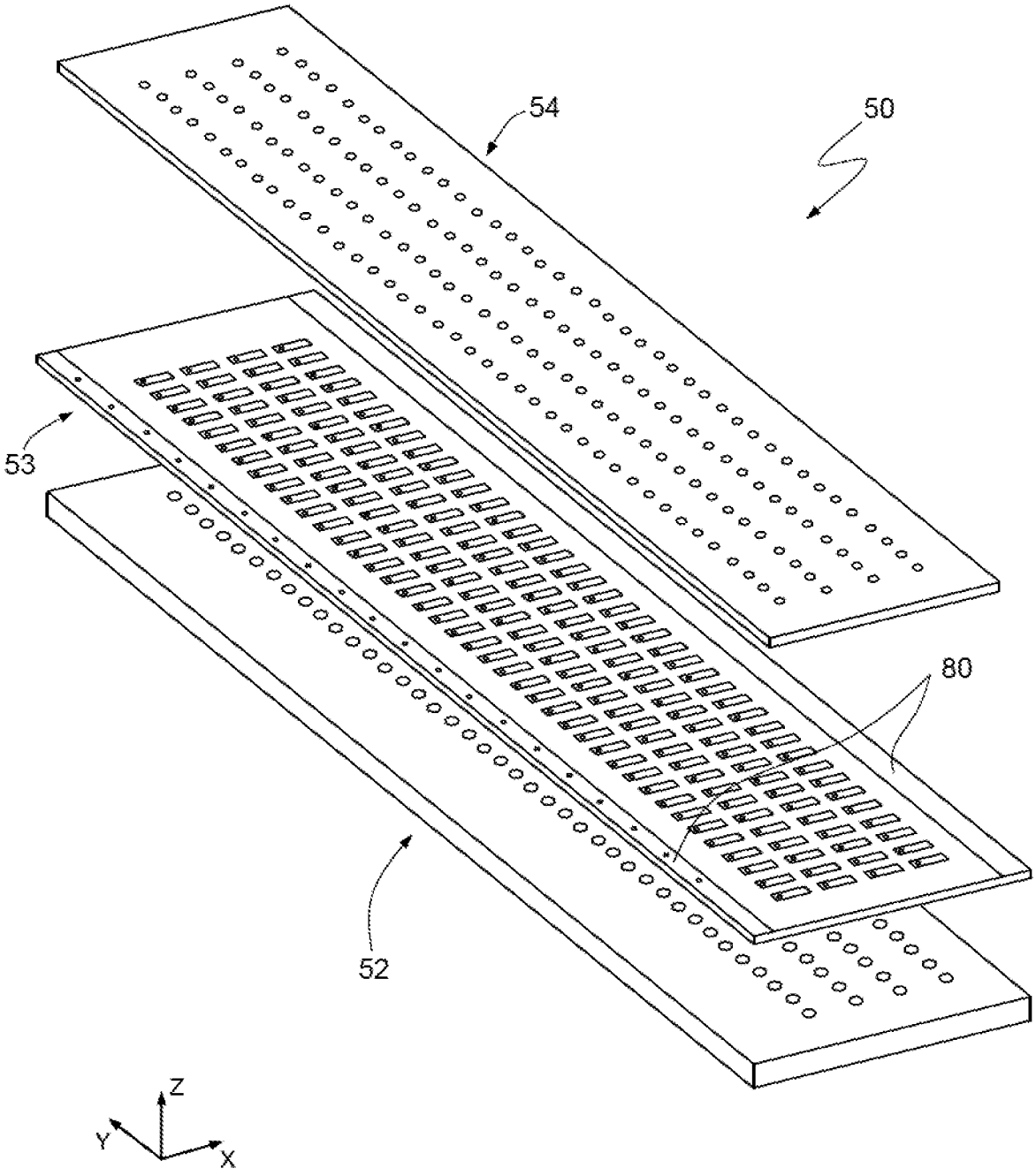
FIG. 4 is a perspective exploded view of the device of FIG. 3.

FIGS. 3 and 4 show a microfluidic device 50 accommodating a plurality of ejecting elements 51, only one whereof is shown in detail in FIG. 3.

The microfluidic device 50 comprises a containment body 50A formed by a nozzle plate 52, an actuator plate 53 and a distribution plate 54, mutually superposed and bonded together.

The nozzle plate 52 is for example of semiconductor material, and forms a plurality of nozzles 58. In particular, the nozzle plate 52 may be formed by a first and a second nozzle layer 55, 56, of silicon, mutually bonded by means of a nozzle bonding layer 57, of silicon oxide. The nozzle plate 52 may have a thickness of about 100 μm.

The actuator plate 53 here comprises a structural layer 59, for example of semiconductor material with a thickness for example of 70 μm, and a membrane layer 60, of material and thickness so as to be able to bend, for example silicon with a thickness between 1 and 4 μm, for example 2.5 μm, covered at be top and at the bottom by silicon oxide layers, not shown. The structural layer 59 forms a plurality of fluid containment chambers 61, one for each ejecting element 51, and it is fixed to the nozzle plate 52 by an intermediate bonding layer 65, for example of silicon oxide. The fluid containment chambers 61 extend through the structural layer 59 and are closed, towards the distribution plate 54, by the membrane layer 60. Each fluid containment chamber 61 is in fluid connection with a respective nozzle 58.

The region of the membrane layer 60 on top of the fluid containment chamber 61 forms a membrane 79.

The membrane layer 60 carries a plurality of actuators 66; each actuator 66 is arranged above a respective membrane 79, is aligned with a respective fluid containment chamber 61 and comprises a first electrode 67, a piezoelectric layer 68, for example of PZT ($PbZrTiO_3$), and a second electrode 69. The first and the second electrode 67, 68 are electrically connected to respective first and second electrical contact lines 70, 71; insulating regions 72, for example of silicon oxide, extend on the top of the electrodes 67, 69 to electrically insulate the various conductive structures.

The distribution plate 54, having a thickness for example of 400 μm, is for example of semiconductor material, such as silicon, is bonded to an upper surface 53*a* of the membrane layer 60 through a membrane bonding layer 74, for example silicon oxide, and forms a plurality of actuator chambers 75, one for each ejecting element 51, each superposed on a respective fluid containment chamber 61 (FIG. 3). In particular, each actuator chamber 75 has a thickness for example of 100 μm, surrounds a respective actuator 66 and allows its movement during the operation of the microfluidic device 50.

The distribution plate 54 has a plurality of through channels 76, one for each ejecting element 51, in communication with a respective fluid containment chamber 61 via corresponding openings 77 in the membrane layer 60 and in the membrane bonding layer 74.

Each through channel 76 and the associated opening 77 form a fluid inlet for the ejecting element 51.

Laterally to the area of the membranes 79, the membrane layer 60 accommodates a control circuit 80, shown only schematically in FIGS. 3 and 4. In particular, as can be seen in FIG. 4, the control circuit 80 may be arranged in one or more peripheral areas of the actuator plate 53. For example, in FIG. 4, in which the microfluidic device 50, in a plan view, has a rectangular shape having long sides, the control circuit 80 is arranged in proximity to both the long sides of the microfluidic device 50.

The control circuit 80 is connected to the actuators 66 through the electrical contact lines 70, 71, as shown schematically in FIG. 3.

In the embodiment shown, the distribution plate 54 has a shorter width (in a direction parallel to the short sides of the microfluidic device 50) than the actuator plate 53 so that a part of the upper surface 53*a* of the actuator plate 53 is accessible from the outside. A plurality of contact pads 81 is formed on the accessible part of the upper surface 53*a* in order to allow electrical connection of the microfluidic device 50 with the outside.

The control circuit 80 may be formed in various ways.

Figure 5:
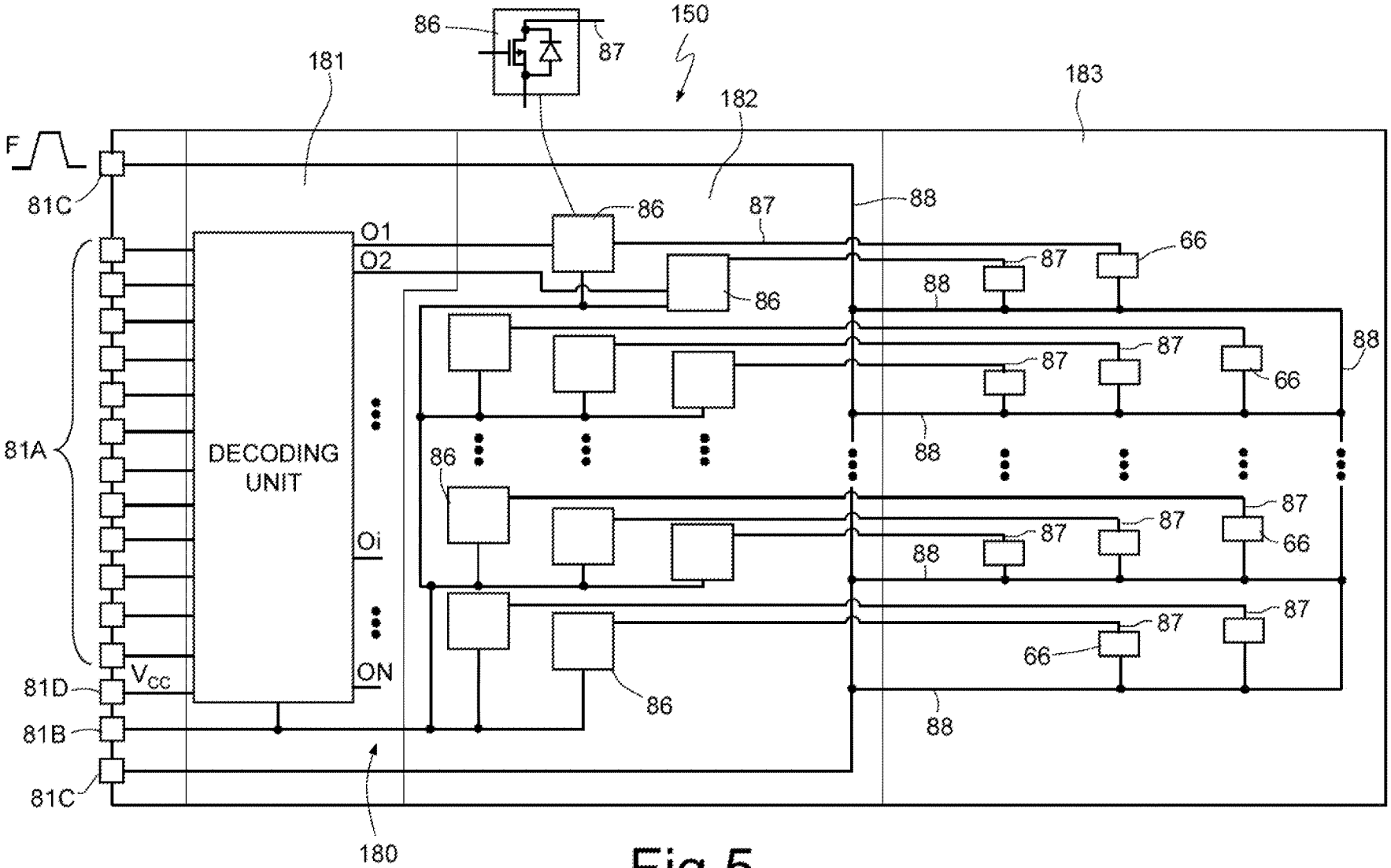
FIGS. 5 and 6 are simplified circuit diagrams of different embodiments of the present device.

For example, FIG. 5 shows an equivalent electrical diagram of an embodiment of a microfluidic device, indicated with 150, and highlights the general structure of the control circuit, here indicated with 180, the connections between the actuators 66 and the control circuit 180.

The control circuit 180 in FIG. 5 comprises a decoding unit 181 and a driving stage 182.

The decoding unit 181 is connected to a first group of pads (addressing pads 81A), designed to receive, in use, addressing signals for the individual ejecting elements 51 (and thus for the respective actuators 66). A further contact pad (ground pad 81B) is grounded; two activation or "fire" pads 81C are designed to receive a fire signal F and a power supply pad 81D receives a power supply voltage $V_{CC}$. The decoding unit 181 has a plurality of outputs O1, O2, . . . , Oi, . . . , ON, in number equal to the number of individual actuators 66, and connected to the driving stage 182.

The driving stage 182 comprises a plurality of switches 86, each having a control terminal connected to a respective output O1, O2, . . . , Oi, . . . , ON of the decoding unit 181. Each switch 86 is further connected to the ground pad 81B and has an output connected to a respective actuator 66 through a connection line 87. The assembly of the actuators 66 is here indicated as actuator unit 183.

The switches 86 may be made by drive transistors, for example of laterally diffused metal oxide semiconductor (LDMOS) type, as shown in the enlarged detail. In this case, the gate terminal of each drive transistor is connected to a respective output O1, O2, . . . , Oi, . . . , ON of the decoding unit 181, the source terminal of each drive transistor is connected to the ground pad 81B and the drain terminal of each drive transistor is connected to a respective first connection line 87.

Each first connection line 87 is connected to one of the electrodes of an actuator 66 of a respective actuator 66, for example to the second electrode 69 (FIG. 3), and thus forms one of the second electrical contact lines 71 of FIG. 3. As shown in FIG. 5, each actuator 66 is also connected to the fire pad 81C through second connection lines 88; in the considered example, thus, the second connection lines 88 correspond to the first electrical contact lines 70 of FIG. 3 and are connected to the first electrodes 67.

In an embodiment, the second connection lines 88 are metal lines formed in a metal level of the microfluidic device 50 and extend over the actuator plate 53; the first connection lines 87, as well as the lines connecting the switches 86 to the ground pad 81B and to the outputs O1, O2, . . . , Oi, . . . , ON of the decoding unit 85, may be formed by conductive paths integrated in the inside of the same actuator plate 53.

Figure 1:
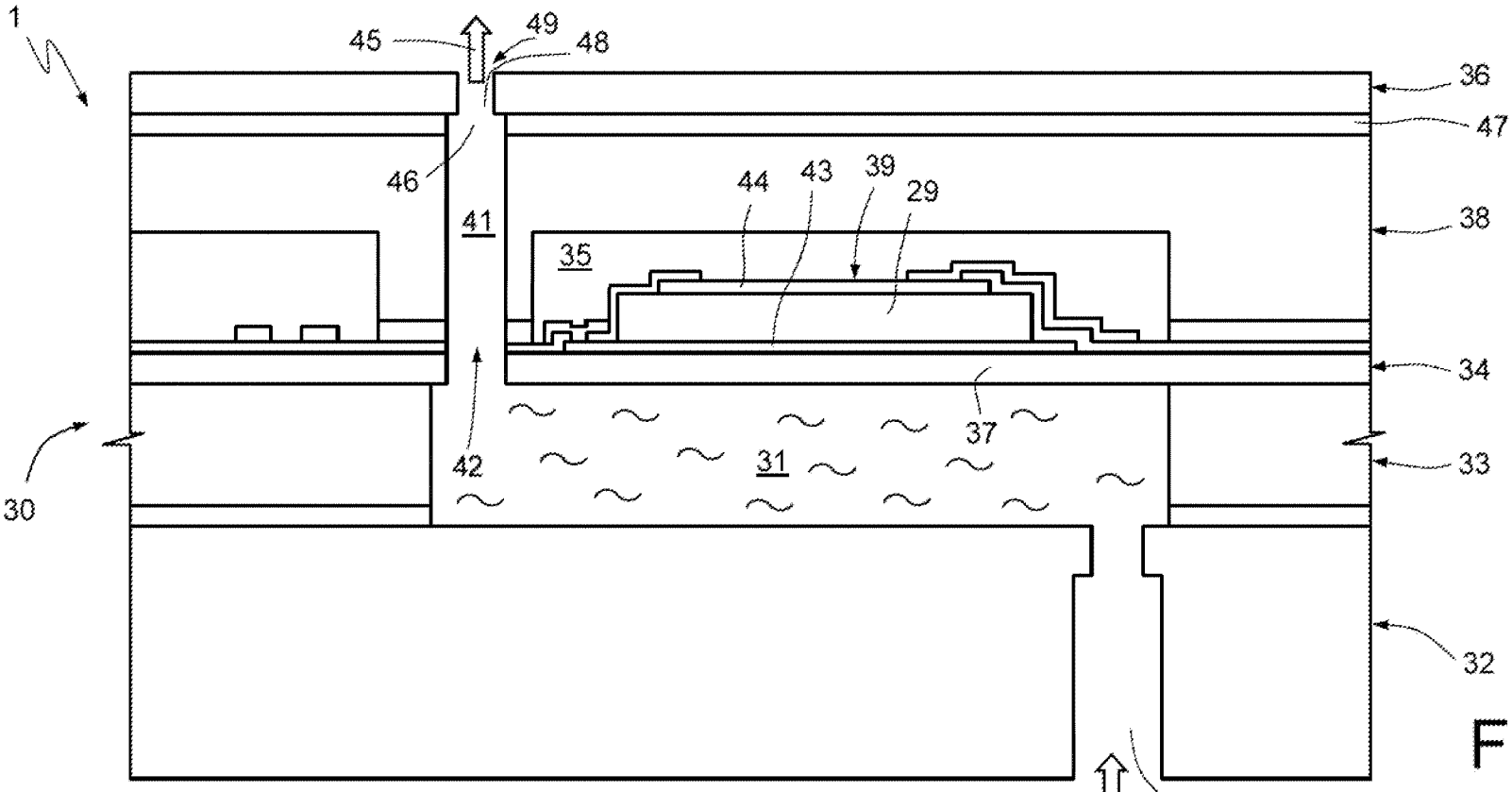
Fig. 1 (Prior Art)
FIG. 1 is a cross-section of an ejecting element of a known microfluidic device of piezoelectric type.
Figure 2:
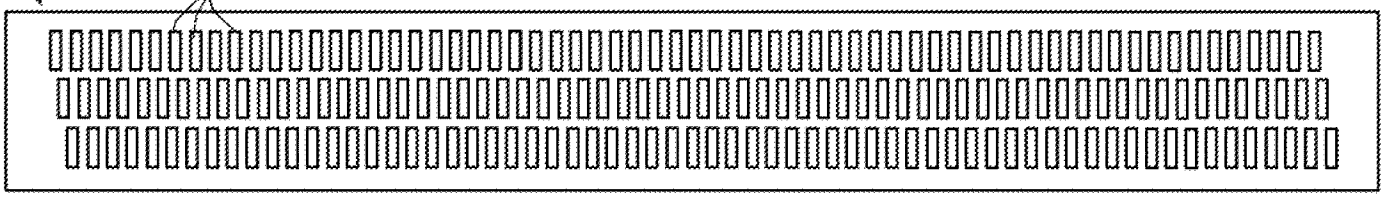
FIG. 2 is a simplified top view showing the arrangement of a plurality of ejecting elements in a microfluidic device.

In the microfluidic device 150 in FIG. 5, the decoding unit 181 receives address signals from the addressing pads 81A, decodes them and selectively enables one or more switches 86, supplying appropriate signals on the respective outputs O1, O2, . . . , Oi, . . . , ON. The enabled switches 86 in turn enable the respective actuators 66 that, upon receiving the activation signal F, cause the deflection of the respective membrane 79 (FIG. 3), causing the emission of a droplet and the successive filling of the fluid containment chamber 61, in a known manner, described above with reference to FIG. 1.

The two activation pads 81C are useful for a better distribution of the activation signal F, so as to avoid current peaks on the leading edges of the activation signal F, in particular when several actuators 66 are activated simultaneously. The two activation pads 81C may be connected to all the actuators 66. As an alternative, each fire pad 81C may be connected to only half of the actuators 66. However, the presence of two activation pads 81C is not mandatory and a single fire pad 81C may be provided or more than two activation pads 81C may be provided.

The decoding unit may be implemented in various ways. For example, FIG. 6 shows an embodiment of a microfluidic device 250 having a decoding unit, here indicated with 281, wherein the addressing signals are supplied in parallel to the addressing pads 81A and the decoding unit 281 enables only one actuator 66 each time.

Figure 6:
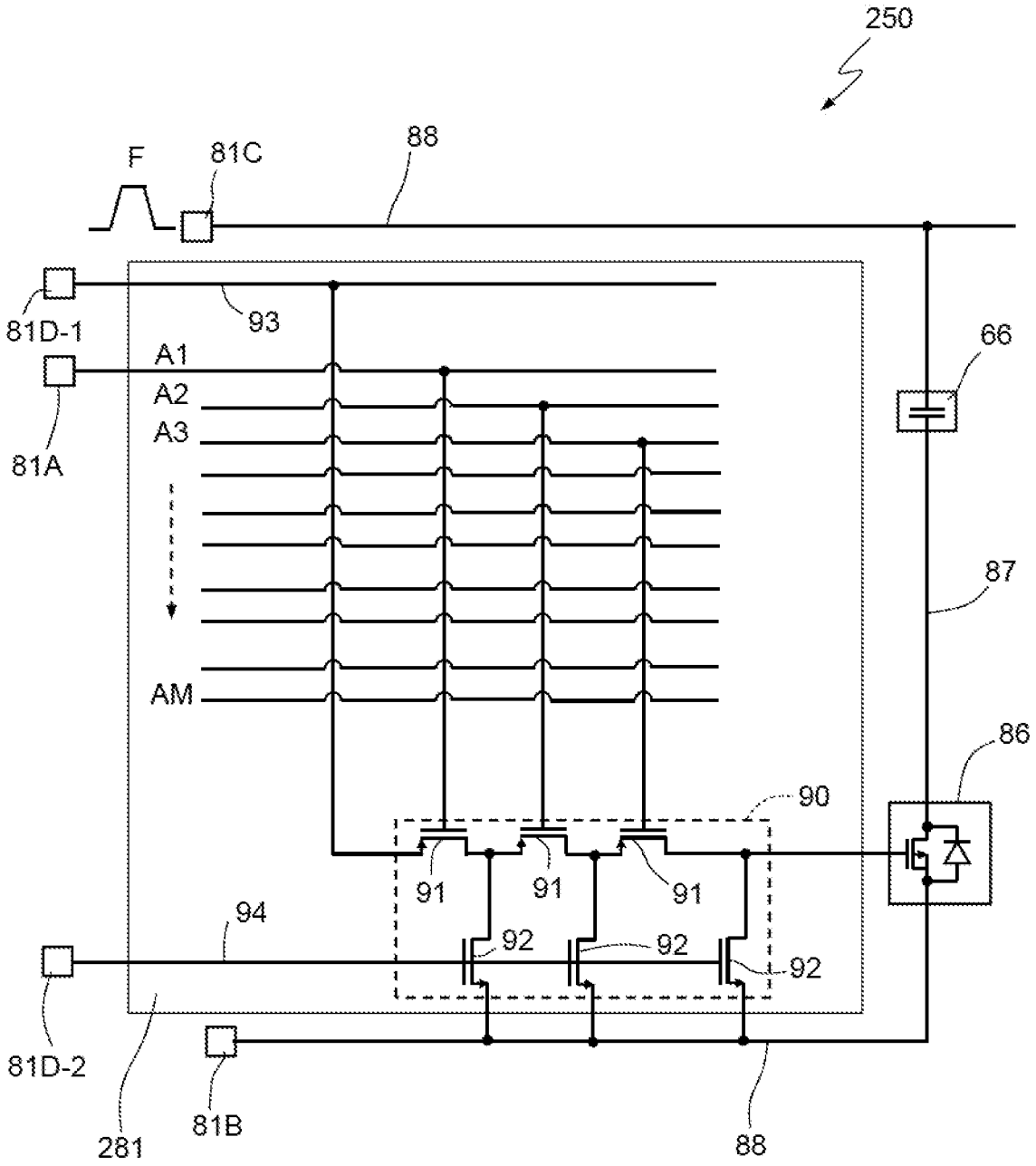

In detail, in FIG. 6, the decoding unit 281 comprises a plurality of addressing lines A1-AM (for example thirteen), each connected to a respective addressing pad 81A and a plurality of decoding circuits 90 (only one shown), in the same number as the actuators 66, and thus switches 86, that may be implemented as shown in FIG. 5.

The decoding circuit 90 comprises three PMOS transistors 91 and three NMOS transistors 92. The PMOS transistors 91 are mutually connected in series between a first enabling line 93 and the gate terminal of a respective switch 86. The gate terminal of each PMOS transistor 91 is connected to an addressing line A1-AM according to an addressing logic. The NMOS transistors 92 are each connected between a respective drain terminal of the PMOS transistors 91 and the second connection lines 88; the gate terminals of the NMOS transistors 92 are connected to a second enabling line 94.

Figure 7:
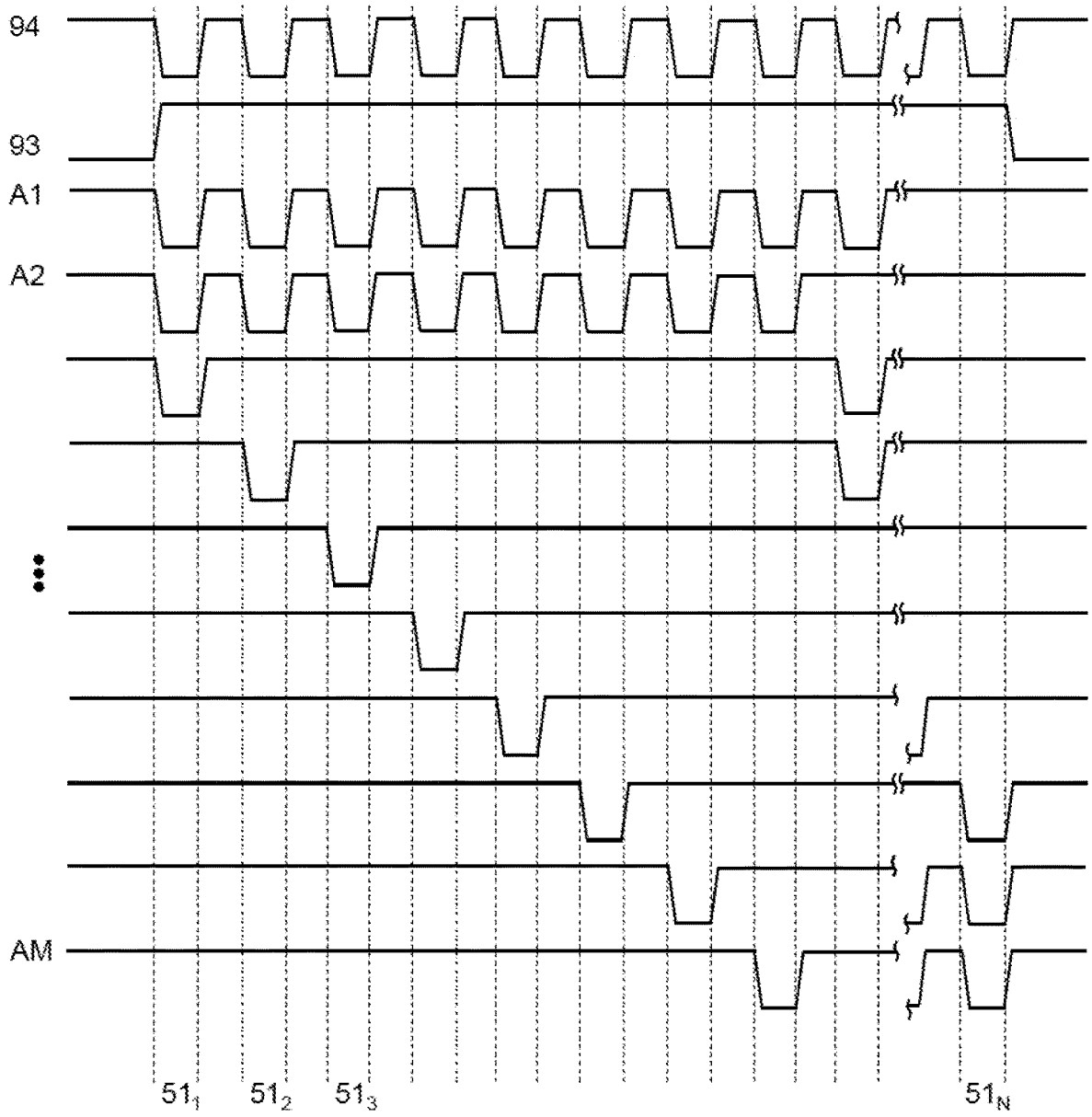
FIG. 7 shows the behavior of electrical signals of the circuit diagram of FIG. 6.

The first and the second enabling lines 93, 94 are connected with the outside through further enabling pads 81D-1 and 81D-2 for receiving control signals for the PMOS transistors 91 and for the NMOS switches 92. In particular, as shown in FIG. 7, illustrating the behavior of some signals in the decoding unit 281 and the ejecting elements $\mathbf{51}_1$, $\mathbf{52}_2$, . . . , $\mathbf{52}_N$ actuated each time, during operation of the microfluidic device 250, the first enabling line 93 supplies a logic signal at the high logic state, for example 3.3 V, enabling the PMOS transistors 91, and the addressing lines A1-AM supply activation pulses. In this phase, the second enabling line 94 continues switching between a high level and a low level. In detail, the second enabling line 94 supplies a low signal and turns NMOS transistors 92 off during the activation pulses supplied on the addressing lines A1-AM and supplies a high logic signal in the intervals between the activation pulses, namely when the lines A1-AM are all high at the same potential of the first enabling line 93. In the intervals between the activation pulses, the PMOS transistors 91 are thus off, the NMOS transistors 92 are on and discharge the floating nodes between the PMOS transistors 91 and the gate terminal of the respective switch 86. The logic signal on the first enabling line 93 is at the low logic state when the decoding unit 281 is at rest.

With the solution in FIG. 6, thus, only one decoding circuit 90 is enabled each time, depending on the addressing signals supplied to the addressing lines A1-AM via the addressing pads 81A and on the wired logic through the connections between the addressing lines A1-AM and the PMOS transistors 91, and supplies a corresponding firing signal to the respective switch 86.

The embodiment in FIG. 6 of the decoding unit 281 also allows the characteristics of each actuator 66 to be measured through the fire pad 81C. In fact, the fire pad 81C allows the enabled actuator 66 to be directly connected with the outside through the respective switch 86. This allows various measurements, for example losses, capacitance or impedance, to be carried out in order to detect the characteristics of the actuator 66, in particular of the piezoelectric layer 68, for example during EWS—Electrical Wafer Sort test) or at the level of the finished microfluidic device 250 and/or when the latter is mounted in an electronic apparatus. In this way, each actuator 66 may be characterized and controlled, verifying the operation quality thereof, at time zero and/or during the lifetime of the product (on the field).

Figure 8:
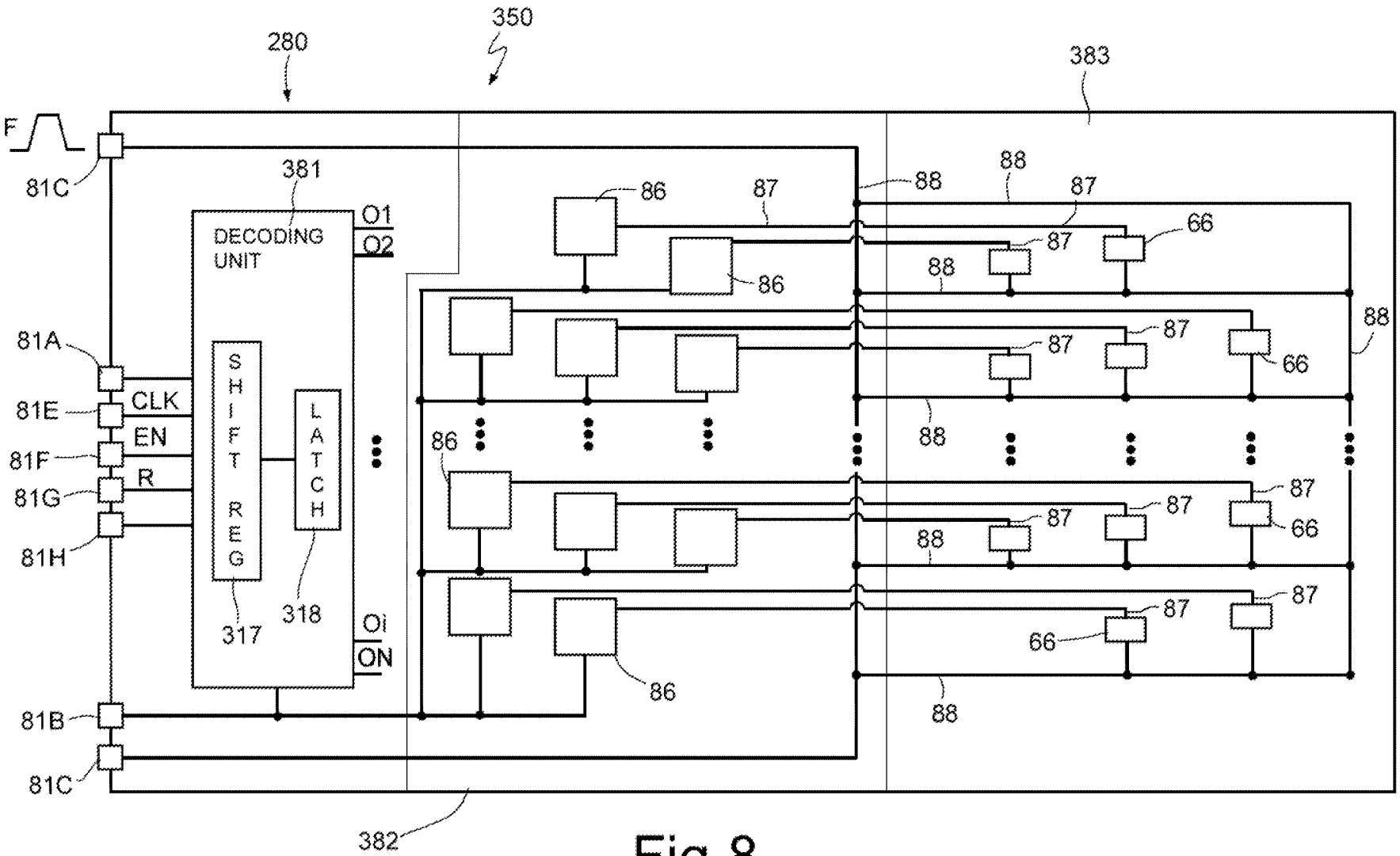
FIGS. 8-10 show simplified circuit diagrams of other embodiments of the present device.

FIG. 8 shows a microfluidic device 350 wherein the decoding unit, here indicated with 381, receives the addressing signals in serial mode, on a single addressing pad 81A. The decoding unit 381, not shown in detail, is substantially formed by shift registers 317 and memory elements (latches) 318 and it is furthermore connected to a timing pad 81E, receiving a clock signal CLK, to an enabling pad 81F, receiving an enabling signal EN, to a reset pad 81G, receiving a reset signal R, and to an output pad 81H, to output signals and/or control commands, in particular when several fluidic devices 350 are cascade-connected.

For the rest, the microfluidic device 350 of FIG. 8 is similar to the microfluidic device 150 of FIG. 5 and will not be described further.

In the microfluidic device 350 of FIG. 8, the address of the ejecting element or elements 51 (and thus of the respective actuators 66) that are simultaneously enabled is introduced in serial mode through the addressing pad 81A, shifted through the shift registers 317 and stored by the latches 318 which selectively enable the switches 86, supplying appropriate signals on the respective outputs O1, O2, . . . , Oi, . . . , ON.

Figure 9:
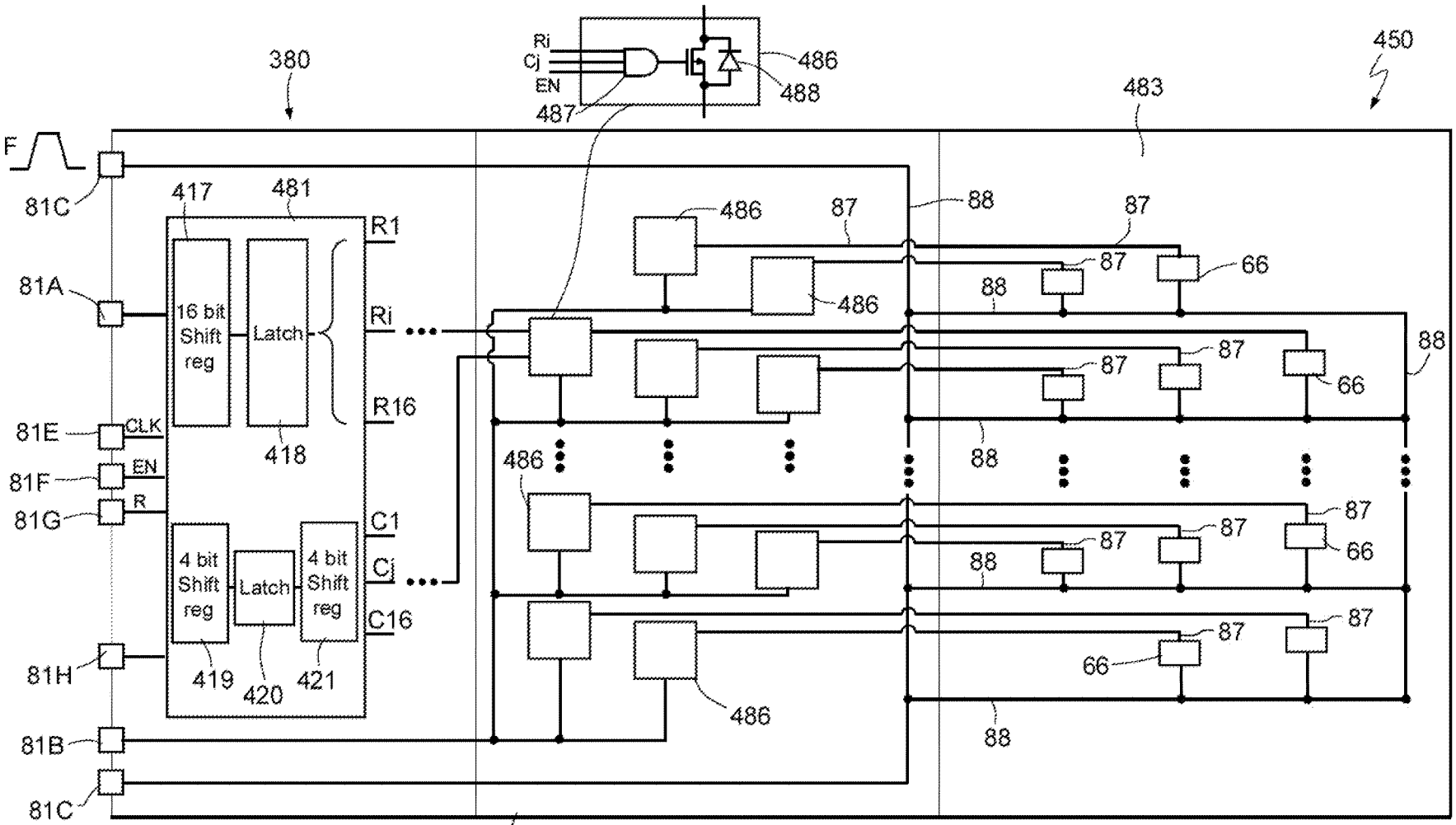

FIG. 9 shows a microfluidic device 450 receiving the addresses in serial mode, analogously to the solution of FIG. 8; in FIG. 9 the decoding unit, here indicated with 481, has a structure that reduces the number of shift registers. In particular, in the embodiment of FIG. 9, four addressing bits and sixteen data bits are supplied on the addressing pad 81A. In the example illustrated, the decoding unit 481 comprises a sixteen-bit word shift register 417, connected at its input to the addressing pad(s) 81A and connected at its output to sixteen data memory elements 418 (for example, latches) and to a four-bit address shift register 419. The address shift register 419 is connected to an address memory element 420. The address memory element 420 is connected at its output to an address decoder 421 having sixteen column outputs C1-C16. The data memory element 418 has sixteen row outputs R1-R16.

Furthermore, analogously to FIG. 8, the microfluidic device 450 is connected to the pads 81B-81H in order to receive/transmit corresponding signals and to supply the provided voltages.

The row outputs R1-R16 and the column outputs C1-C16 are connected to the switches, here indicated as 486, one whereof is shown by way of example in the enlarged detail. In particular, each switch 486 comprises an AND gate 487 and a drive transistor 488, of the LDMOS type. Each AND gate 487 is connected to the enabling pad 81F, and also to a respective row output Ri and to a respective column output Cj; the various connection combinations of the inputs of the AND gates 487 of the switches 486 with the row outputs R1-R16 and the column outputs C1-C16 thus allow an actuator 66 or a plurality of actuators 66 connected to the same column output C1-C16 to be independently selected.

The embodiment of FIG. 9 thus allows up to sixteen actuators 66 to be simultaneously controlled.

Figure 10:
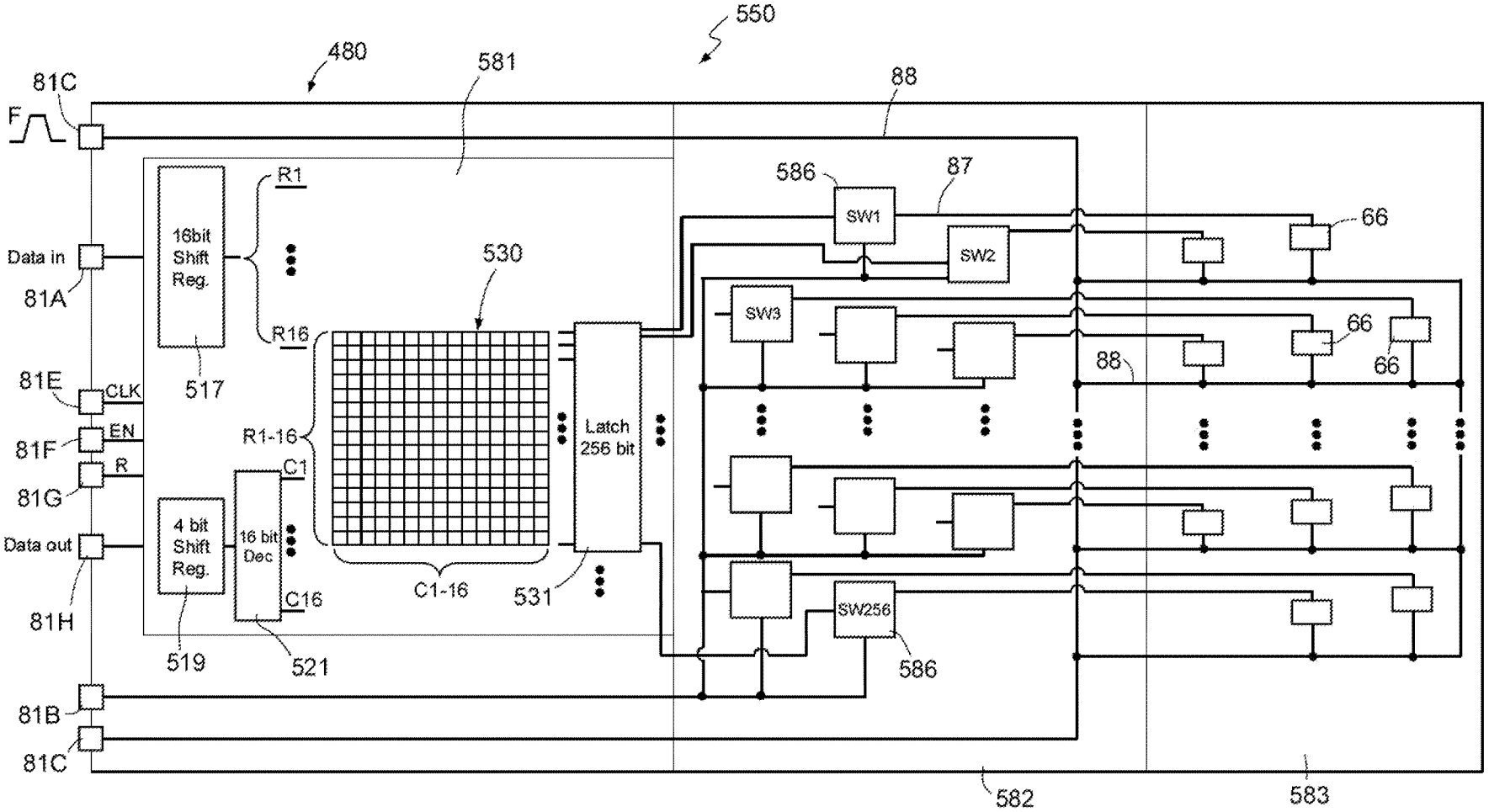

FIG. 10 shows a microfluidic device 550 wherein the decoding unit 581 comprises a sixteen-bit word shift register 517, connected at its input to the addressing pad(s) 81A and at its output to a four-bit address shift register 519. The outputs of the address shift register 519 are connected to an address decoder 521 having sixteen column outputs C1-C16. The word shift register 517 has sixteen row outputs R1-R16.

The row and column outputs R1-R16, C1-C16 are connected to an addressing matrix 530 having a plurality of AND gates each arranged at a respective intersection node between the row outputs R1-R16 and the column outputs C1-C16. In the instant example of sixteen rows and sixteen columns, the addressing matrix 530 thus has 16×16=256 nodes, each whereof supplies an enable state for a respective switch 586. These states are stored in a state memory 531, for example comprising a 256-bit latch. The outputs of the state memory 531 are each connected to a respective switch 586, for example formed by an LDMOS transistor, as shown in FIG. 5.

The microfluidic device 450 of FIG. 10 can thus be implemented with fewer shift registers compared with the microfluidic device 450 of FIG. 9, however with a larger number of memory cells. In this way, it is furthermore possible to control sixteen actuators 66 in parallel (i.e., the actuators 66 controlled by the same row of the addressing matrix 530) speeding up the liquid ejection cycle and thus printing.

The microfluidic device described here has numerous advantages.

First, it allows the number of external contact pads to be drastically reduced, reducing the complexity of the wiring operations and thus increasing the yield.

Furthermore, the area needed for forming the pads is reduced.

The assembly is notably simpler than known microfluidic devices, for a same number of ejecting elements, and thus the assembly costs are reduced.

The integration of the decoding and driving electronics is not critical from the point of view of the thermal budget, since the ejected ink or liquid acts as a cooling fluid.

Finally, it is apparent that modifications and variants may be applied to the microfluidic device described and illustrated without however departing from the scope of the present disclosure.

In particular, the decoding unit may be formed in any desired manner.

Furthermore, the described microfluidic device may be used in a different apparatus. In particular, other than in an inkjet printer apparatus, it may be used for ink and/or fragrance sprayers, where it is desired to selectively control at least groups of ejecting elements.

The described microfluidic device may be also used for example in an apparatus of a biological or biomedical type, for local application of biological material (e.g., DNA) during manufacturing of sensors for biological analyses, and/or for administration of medicines.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A microfluidic device, comprising:

a containment body;

an actuation membrane layer accommodated in the containment body;

a plurality of ejecting elements arranged adjacent to each other and accommodated in the containment body, each ejecting element including an actuation membrane portion that is part of the actuation membrane layer, a liquid inlet, a containment chamber, a piezoelectric actuator on the actuation membrane layer, and an ejection nozzle; and a control circuit configured to generate actuation signals that actuate the piezoelectric actuators, wherein the control circuit is integrated in the actuation membrane layer, the control circuit including:

a driving stage that comprises a plurality of driver switches coupled to the piezoelectric actuators, respectively, each driver switch having a control input; and a decoding stage coupled to the control input of each driver switch.

2. The microfluidic device according to claim 1, wherein the containment body comprises a distribution region, an actuation region and a nozzle region, wherein the distribution region accommodates the liquid inlets, the actuation region carries the piezoelectric actuators, and the nozzle region forms the ejection nozzles of the ejecting elements, the control circuit being integrated into the actuation region.

3. The microfluidic device according to claim 2, wherein the distribution region, the actuation region and the nozzle region include separate, mutually bonded plates.

4. The microfluidic device according to claim 2, wherein the actuation region has a first width and at least one of the distribution region and the nozzle region has a second width smaller than the first width.

5. The microfluidic device according to claim 4, wherein the actuation region has an accessible surface portion, the microfluidic device including contact pads formed on the accessible surface portion and electrically connected to the control unit.

6. The microfluidic device according to claim 1, wherein each piezoelectric actuator of a respective ejecting element of the plurality of ejecting elements is configured to deflect the actuation membrane portion of the respective ejecting element to cause fluid in the containment chamber of the respective ejecting element to be force through the ejection nozzle of the respective ejecting element.

7. The microfluidic device according to claim 1, wherein the decoding stage includes:

a plurality of address lines configured to receive respective address signals;

a plurality of decoding circuits electrically coupled to the control inputs of the driver switches, respectively, each decoding circuit including:

a plurality of first switches electrically connected in series between a first enabling line and the control input of the respective switch, each of the first switches being electrically coupled to a different one of the address lines; and a plurality of second switches connected respectively between a respective one of the first switches and a ground terminal, each of the second switches having a control input coupled to a second enabling line.

8. The microfluidic device according to claim 1, wherein the decoding stage comprises:

a serial input configured to receiving addresses of the ejecting elements, respectively;

shift registers configured to receive the addresses; and memory elements respectively coupled to the shift registers and to the driving switches, each memory element being configured to store a corresponding one of the addresses upon receipt from the respective shift register and control the respective driving switch based on the address.

9. The microfluidic device according to claim 1, wherein the decoding stage includes:

an addressing pad;

a first shift register having an input, coupled to the addressing pad, and a plurality of row outputs;

a second shift register having inputs, coupled to the row outputs, and a plurality of outputs;

a decoder having inputs, coupled to the outputs of the second shift register, and a plurality of column outputs;

an addressing matrix having a plurality of logic gates each respectively arranged at respective intersection nodes and having first inputs coupled respectively the row outputs and second inputs coupled respectively to the column outputs, each logic gate being configured to supply an enable state based on the row and column outputs coupled to the first and second inputs of the logic gate; and a memory coupled to the logic gates and driver switches configured to store the enable states and control the driver switches based on the enable states.

10. The microfluidic device according to claim 1, wherein the driving stage further comprises a plurality of logic gates, each logic gate having inputs connected to the decoding stage and an output connected to a gate terminal of a respective one of the LDMOS transistors.

11. The microfluidic device according to claim 10, wherein the decoder stage includes:

an addressing pad;

a first shift register having an input, coupled to the addressing pad, and a plurality of outputs;

a plurality of memory elements having a plurality of inputs, respectively coupled to the outputs of the first shift register, and a plurality of row outputs;

a second shift register having inputs, coupled to the outputs of the first shift register, and a plurality of outputs; and a third shift register having inputs, coupled to the outputs of the second shift register, and a plurality of column outputs, wherein the inputs of each logic gate include a first input coupled to a corresponding one of the row outputs and a second input coupled to a corresponding one of the column outputs.

12. A microfluidic device, comprising:

a nozzle plate including a plurality of ejection nozzles of a plurality of ejecting elements, respectively, arranged adjacent to each other;

an actuator plate coupled to the nozzle plate and including a plurality of containment chambers of the plurality of ejecting elements, respectively, and a plurality of piezoelectric actuators of the plurality of ejecting elements, respectively;

a distribution plate coupled to the actuator plate and including a plurality of fluid inlets of the plurality of ejecting elements, respectively, and a control circuit configured to generate actuation signals that actuate the piezoelectric actuators, wherein the control circuit is integrated in one of the nozzle plate, actuator plate, and distribution plate, the control circuit including:

a driving stage that comprises a plurality of driver switches coupled to the piezoelectric actuators, respectively, each driver switch having a control input; and a decoding stage coupled to the control input of each driver switch, the decoding stage including:

a plurality of address lines configured to receive respective address signals; and a plurality of decoding circuits electrically coupled to the control inputs of the driver switches, respectively, each decoding circuit including:

a plurality of first switches electrically connected in series between a first enabling line and the control input of the respective switch, each of the first switches being electrically coupled to a different one of the address lines; and a plurality of second switches connected respectively between a respective one of the first switches and a ground terminal, each of the second switches having a control input coupled to a second enabling line.

13. The microfluidic device according to claim 12, wherein each ejecting element includes an actuation membrane portion and each actuation membrane portion is a part of an actuation membrane layer that carries the piezoelectric actuators, the control circuit being integrated in the actuation membrane layer.

14. The microfluidic device according to claim 13, wherein each piezoelectric actuator of a respective ejecting element of the plurality of ejecting elements is configured to deflect the actuation membrane portion of the respective ejecting element to cause fluid in the containment chamber of the respective ejecting element to be force through the ejection nozzle of the respective ejecting element.

15. The microfluidic device according to claim 12, wherein the actuator plate has an accessible surface portion, the microfluidic device including contact pads formed on the accessible surface portion and electrically connected to the control unit.

16. An ink injection device, comprising:

a plurality of ejecting elements arranged adjacent to each other, each ejecting element including an ink inlet, an ink containment chamber, a piezoelectric actuator, an actuation membrane portion, and an ink ejection nozzle, each piezoelectric actuator of a respective ejecting element of the plurality of ejecting elements being configured to deflect the actuation membrane portion of the ejecting element to cause ink in the containment chamber of the ejecting element to be force through the ink ejection nozzle of the ejecting element; and a control circuit configured to generate actuation signals that actuate the piezoelectric actuators, wherein each actuation membrane portion is a part of an actuation membrane layer that carries the piezoelectric actuators, the control circuit being integrated into the actuation membrane layer, the control circuit including:

a driving stage that comprises a plurality of driver switches coupled to the piezoelectric actuators, respectively, each driver switch having a control input;

a decoding stage coupled to the control input of each driver switch.

17. The ink injection device according to claim 16, wherein the decoding stage comprises:

a serial input configured to receiving addresses of the ejecting elements, respectively;

shift registers configured to receive the addresses; and memory elements respectively coupled to the shift registers and to the driving switches, each memory element being configured to store a corresponding one of the addresses upon receipt from the respective shift register and control the respective driving switch based on the address.

18. The ink injection device according to claim 16, wherein the decoding stage includes:

a plurality of address lines configured to receive respective address signals;

a plurality of decoding circuits electrically coupled to the control inputs of the driver switches, respectively, each decoding circuit including:

a plurality of first switches electrically connected in series between a first enabling line and the control input of the respective switch, each of the first switches being electrically coupled to a different one of the address lines; and a plurality of second switches connected respectively between a respective one of the first switches and a ground terminal, each of the second switches having a control input coupled to a second enabling line.

* * * * *